US009257105B1

(12) United States Patent
Nagahara

(10) Patent No.: US 9,257,105 B1
(45) Date of Patent: Feb. 9, 2016

(54) C# MECHANISM FOR FLUTES AND PICCOLOS

(71) Applicant: Kanichi Nagahara, Chelmsford, MA (US)

(72) Inventor: Kanichi Nagahara, Chelmsford, MA (US)

( * ) Notice: Subject to any disclaimer, the term of this patent is extended or adjusted under 35 U.S.C. 154(b) by 0 days.

(21) Appl. No.: 14/546,129

(22) Filed: Nov. 18, 2014

(51) Int. Cl.
*G10D 9/04* (2006.01)

(52) U.S. Cl.
CPC ..... *G10D 9/043* (2013.01)

(58) Field of Classification Search
CPC ..... G10D 9/043
See application file for complete search history.

(56) References Cited

U.S. PATENT DOCUMENTS

| | | | | |
|---|---|---|---|---|
| 1,336,359 | A | 4/1920 | Loomis | |
| 2,569,029 | A * | 9/1951 | Sylvester | G10D 9/043 84/385 R |
| 3,079,828 | A * | 3/1963 | LeBlanc | G10D 7/066 84/382 |
| 3,890,874 | A | 6/1975 | Vedder | |
| 3,941,026 | A * | 3/1976 | Hildebrandt | G10D 7/066 84/382 |
| 4,534,261 | A | 8/1985 | Fabrizio | |
| 4,793,235 | A * | 12/1988 | Yamaryo | G10D 9/043 84/380 R |
| 4,798,120 | A | 1/1989 | Brogger | |
| 4,809,580 | A * | 3/1989 | Yamaryo | G10D 9/043 84/382 |
| 4,819,538 | A | 4/1989 | Nelson | |
| 6,259,010 | B1 | 7/2001 | Nagahara | |
| 7,394,007 | B2 | 7/2008 | Keefe et al. | |
| 7,439,428 | B1 * | 10/2008 | Nagahara | G10D 7/026 84/380 R |
| 7,589,268 | B2 * | 9/2009 | Keefe | G10D 9/043 84/384 |
| 7,851,685 | B2 | 12/2010 | Reibner | |
| 8,389,840 | B2 | 3/2013 | Braun | |

FOREIGN PATENT DOCUMENTS

| | | |
|---|---|---|
| EP | 2138995 B1 | 9/2011 |
| WO | 0131626 A1 | 5/2001 |

OTHER PUBLICATIONS

Matthias Kuhn, Revolutionary new flute requiring no change in fingering by Jacques Zoon, Jul. 4, 2014, https://www.youtube.com/watch?v=Yc8cOVG14gE.

Jacques Zoon, Automatic C-sharp-System, PAN Magazine, Mar. 2014, http://www.zoonmaiaflutes.com/csharp-system.

* cited by examiner

*Primary Examiner* — Robert W Horn
(74) *Attorney, Agent, or Firm* — Lambert & Associates; Gary E. Lambert; David J. Connaughton, Jr.

(57) ABSTRACT

A wind-blown instrument tone hole configuration is provided. Further, a key mechanism to operate the instrument is provided to allow various opening and closing of the instrument tone holes.

20 Claims, 4 Drawing Sheets

C# MECHANISM FOR FLUTES AND PICCOLOS

BACKGROUND OF THE INVENTION

1. Field of the Invention

The present invention relates generally to wind-blown musical instruments. More particularly the present invention relates to a C# tone-hole mechanism for flutes and piccolos.

2. Description of Related Art

The modern flute, as designed by Theobald Boehm in 1847, was the last major innovation in flute design. Previously, instrument makers built their flutes based on the hands of the performers, that is, the various tone holes of the instrument were placed longitudinally along the tube with the main consideration being that they would be in reach of the performer's fingers, rather than where they might be best placed acoustically. Boehm's innovation was to place the tone holes where they belong for the best musical performance, then build a mechanical system of keys which would allow the performer to close the various holes without contorting the hand into an uncomfortable position. Further, now that the fingers were covering keys upon tone holes, rather than covering the tone hole directly with the finger pad, said tone holes could be enlarged to provide better ventilation, which improved the stuffy tone and ventilation problems of earlier flutes.

Boehm is responsible for calculating the most effective size for the tone holes of the flute, but was forced into several compromises of his ideal design, as the player can only bring 9 fingers (the right-hand thumb is used to support the instrument and does not cover or actuate any key) to bear upon the theoretical 12 tone holes corresponding to the 12 semitones of a musical octave. The compromise with which the present invention is concerned is that of the C#4 tone hole.

In order to expand the range of the flute into the upper octaves while simultaneously providing the optimum intonation possible for the greatest number of pitches, Boehm was forced to use a smaller diameter tube than would otherwise be indicated, that is, the tube's diameter is out of proportion with its length. The result of this is that the pitches D4 and D#4 have a noticeably different tonal color than the immediately adjacent pitches, which is undesirable in musical performance. Boehm knew that the flute should have, in actuality, three separate tone holes, one each for C#4, D4 and D#4. Unfortunately, there is only one finger available in this location, and it must be used for C#4. Through experimentation, Boehm's compromise resulted in a C# tone hole that was of smaller diameter and placed higher up on the instrument tube so that it could also serve as a vent hole for D4, D#4, D5, G#5, A5, and A#5. Boehm realized that he would be unable to create a perfectly in-tune instrument, as addressing the intonation of any one pitch was likely to adversely affect several other pitches, and so on.

Since the development of the modern flute by Boehm in the mid-19th century, several designs have emerged to address the issue of the C#4 tone hole, and provide the proper ventilation for the pitch C#4, as well as the other pitches previously mentioned. These designs address the issue by replacing the current C#4 tone hole with two separate tone holes, one to serve as a dedicated C#4 tone hole, and the other—placed on the opposite side of the instrument—to serve as the vent hole for the pitches D4, D#4, D5, G#5, A5, and A#5. However, these designs have typically involved rather complex mechanical solutions, which result in inefficient mechanical action, keys working against each other, and increased opportunity for maladjustment in the mechanism.

Further, the placement of the vent tone hole on the opposite side of the instrument (which was previously thought necessary due to the need to close one hole while opening the other) prevents the addition of a "C#-trill mechanism," which is a popular option among flute players.

Therefore, what is needed is a tone and vent hole configuration on a flute or piccolo that allows a proper sized tone hole, and an appropriate vent hole, as well as a corresponding key mechanism to operate the tone hole and vent hole.

SUMMARY OF THE INVENTION

The subject matter of this application may involve, in some cases, interrelated products, alternative solutions to a particular problem, and/or a plurality of different uses of a single system or article.

In one aspect, a key mechanism for a wind-blown instrument is provided. The key mechanism comprises a C# tone hole key configured to cover a C# tone hole when in a closed position. The mechanism further comprises a C# vent hole key configured to cover a C# vent hole when in a closed position. Both keys are movable between an open position and the closed position. A touch key is positioned to simultaneously move both the C# tone hole key and C# vent hole key to the closed position when it is depressed. Further, a second tone hole key is configured to cover a tone hole other than the C# tone hole when in a closed position. This second tone hole key is in mechanical connection with the C# tone hole key, such that when the second tone hole key is depressed, the C# tone hole key is also depressed. The mechanism further has a spring lever providing a mechanical communication between the second tone hole key and the C# vent hole key. When the second tone hole key is depressed, the C# vent hole key is opened. However, the spring lever may yield against a force of the touch key to close the C# vent hole key when the touch key is depressed.

In another aspect, a flute or piccolo is provided. The flute or piccolo comprises a body, and a plurality of tone holes and/or vent holes defined by the body. The flute or piccolo further comprises a key mechanism attached to the body configured to open and close one or more of the plurality of tone holes and/or vent holes in a plurality of different configurations. The key mechanism may comprise a C# tone hole key configured to cover a C# tone hole when in a closed position. The mechanism further comprises a C# vent hole key configured to cover a C# vent hole when in a closed position. Both keys are movable between an open position and the closed position. A touch key is positioned to simultaneously move both the C# tone hole key and C# vent hole key to the closed position when depressed. Further, a second tone hole key is configured to cover a tone hole other than the C# tone hole when in a closed position. This second tone hole key is in mechanical connection with the C# tone hole key, such that when the second tone hole key is depressed, the C# tone hole key is also depressed. The mechanism further has a spring lever providing a mechanical communication between the second tone hole key and the C# vent hole key. When the second tone hole key is depressed, the C# vent hole key is opened. However, the spring lever may yield against a force of the touch key to close the C# vent hole key when the touch key is depressed.

DETAILED DESCRIPTION

Figure 1:
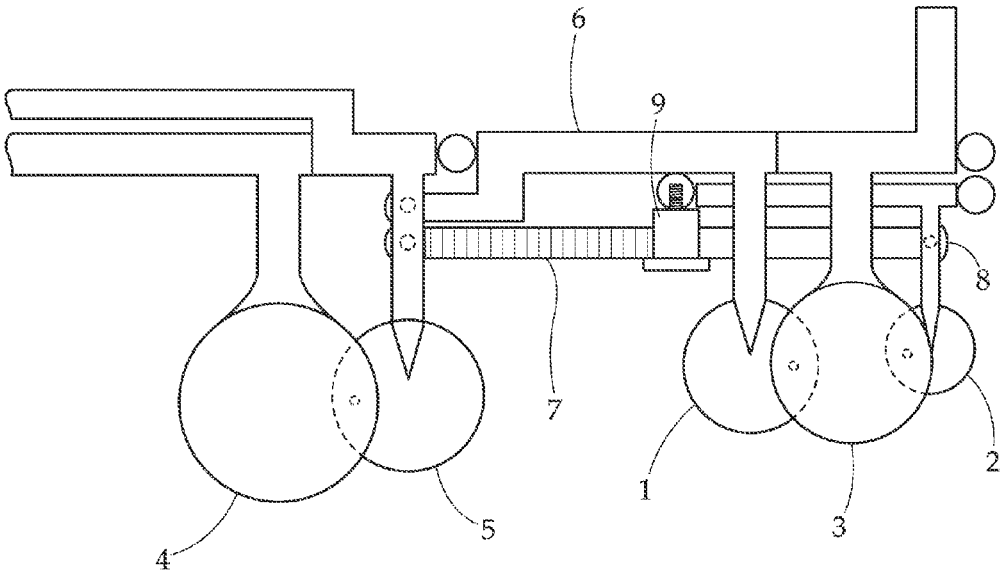
FIG. 1 provides a view of an embodiment of a key mechanism of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

In the prior art, the C# tone hole has been called upon to perform several tasks in regulating the pitch of various notes on a flute and piccolo, in that the C# tone hole must operate as both a vent hole as well as a tone hole. The result of this is that none of the notes that make demands on this single C# tone/vent hole is perfectly in tune. This also results in the prior art C# tone/vent hole having a different than optimal size, causing it to not produce an ideal C# note.

Generally, the present invention concerns a wind-blown flute or piccolo body that replaces the traditional prior art C# combination tone and vent hole with two adjacent holes, one being the tone hole, and the other being a vent hole. Moreover, the present invention further concerns a key mechanism that allows the C# tone hole and vent hole to be opened or closed in various combinations depending on the needs of the note being played. By placing the C# tone hole and C# vent hole adjacent to each other, it allows the addition of a C#-trill mechanism, which is a popular option, and not available without the tone and vent hole being adjacent.

The key mechanism contemplated herein, speaking generally, is configured to allow the C# vent hole to remain open in some cases while the C# tone hole is closed. Similarly, in other cases both the C# vent hole and tone hole may be opened or closed. Further still, generally the C# vent hole has a key that is biased in the closed position, such that the C# tone hole may be open, while the C# vent hole is closed. The inventive key mechanism contemplated herein allows for all of these varied configurations without a change in fingering required by the instrument player.

While the term "flute" is used throughout, it should be understood that, as used herein, the term "flute" is intended to refer not only to flutes, but to many other similarly configured wind-blown instruments, and may particularly also apply to piccolos.

The term "tone hole" is used herein to refer to a hole in the body of the wind-blown instrument that provides pitch control based on if it is opened (not covered by a key), or closed (covered by a key). The term "vent hole" is used herein to refer to a hole in the body of the wind-blown instrument that provides venting for certain notes to optimize tone.

In one embodiment, for a piccolo, the C# tone hole may be sized to have an approximately 0.27-0.31 inch diameter, and preferably an approximately 0.296 inch diameter, while the C# vent hole may have an 0.12-0.16 inch diameter, preferably an approximately 0.140 inch diameter. In this embodiment, the C# vent hole center may be approximately 0.3-0.4 inches away from the C# tone hole center, and preferably approximately 0.38 inches away. In another embodiment, the C# tone hole may be approximately 7.545 inches away from the end of the piccolo body. In still another embodiment, the C# vent hole may be approximately 7.925 inches away from the end of the piccolo body. It should be understood however, that the specific sizes and positions of these holes may vary in different embodiments. For example, the sizing and positioning will be different on a flute than on a piccolo.

Turning now to FIG. 1, an elevation view of the key mechanism of the present invention is provided. Key 1 is configured to cover the C# tone hole. Key 2 is configured to cover the C# vent hole. Touch key 3 is positioned over the two, such that when depressed, both keys 1 and 2 are depressed, closing their respective holes. Similarly, key 5 is positioned over a tone hole, and is activated by touch key 4 so that when touch key 4 is depressed, key 5 depresses, covering its hole. It should be understood that in preferred embodiments, the C# vent hole key 2 is biased by a spring, such as a needle spring, in a closed position.

The key mechanism further comprises levers further allowing additional key control in various situations. Lever 6 connects tone hole key 5 to the C# tone hole key 1. While lever 6 is shown as a direct mechanical lever connection, it should be understood that any mechanical or equivalent connection between the two keys may be employed without straying from the scope of this invention. Further, it should be understood that C# tone hole key 1 can be closed without closing tone hole key 5. As such, when the tone hole key 5 is depressed, C# tone hole key 1 will also be depressed. Further, spring lever, having a spring side 7, and a lever side 8 is connected to the tone hole key 5. The spring lever spring side 7 is configured as a flexible member, such as a leaf spring. The spring side is resilient enough so that when tone hole key 5 is depressed, the lever will pivot about its connection 9, raising lever end 8. Lever end 8 is positioned under the C# vent hole key 2. Therefore, when the lever end 8 is raised, it lifts C# vent hole key 2 up against its biased down position, providing venting for the note. However, spring side 7 is flexible enough such that if touch key 3 is depressed (urging the C# vent hole key 2 up), along with touch key 4 (closing tone hole key 5) the spring side 7 can yield against the touch key force, allowing the C# vent hole key 2 to close against the force of the spring side 7 of the lever.

The key mechanism structure thus allows various combinations as needed for key opening and closing. For example, touch key 4 alone can depress key 5 and C# tone hole key 1. Depending on the action on touch key 3, C# vent key 2 will be either open (if touch key 3 is not depressed), or closed (if touch key 3 is depressed). This allows correct ventilation of certain pitches, such as, for example D4, D#4, D5, G#5, A5, and A#5, while also allowing for proper and optimum intonation and tonal color. This configuration further allows for the addition of a C#-trill mechanism (not shown).

Figure 2:
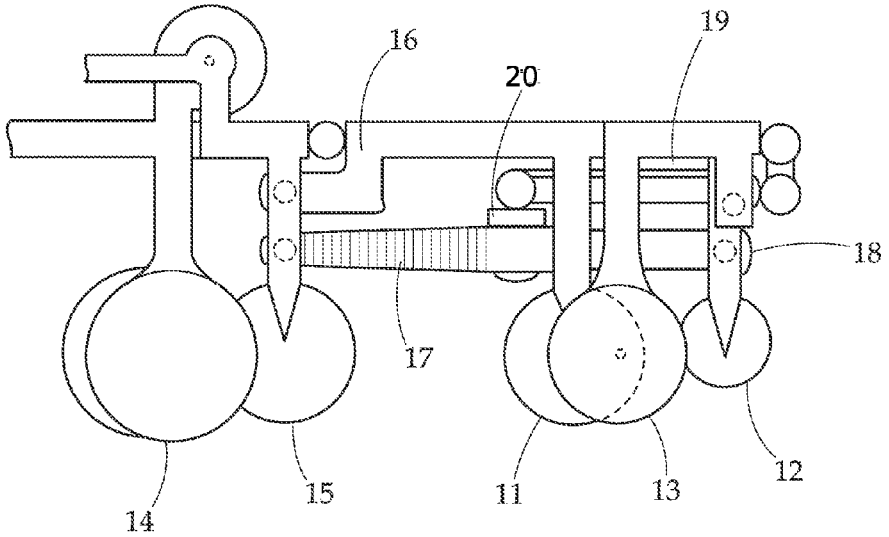
FIG. 2 provides a view of another embodiment of a key mechanism of the present invention.
Figure 5:
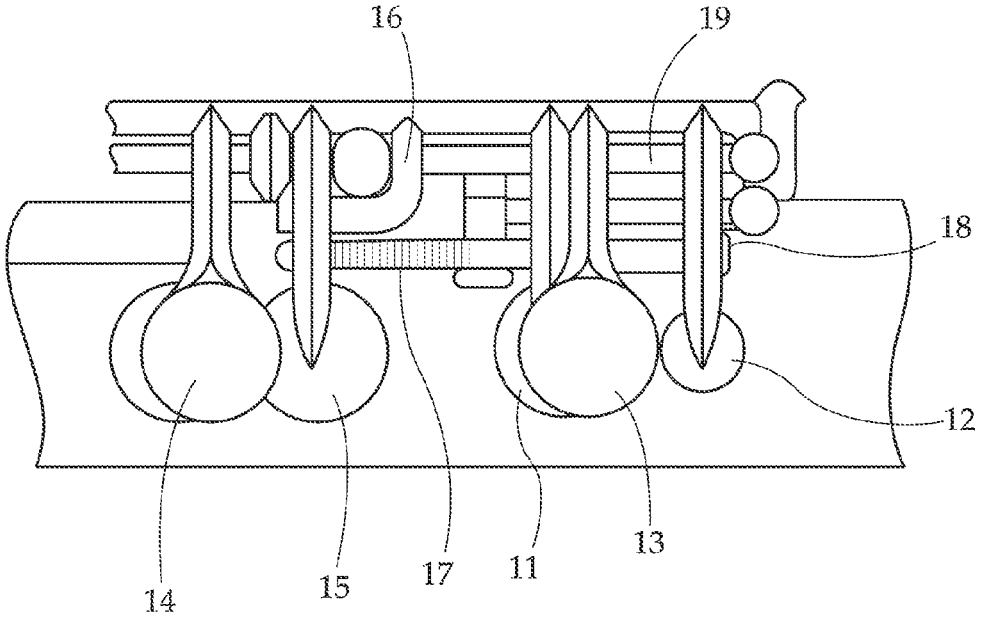
FIG. 5 provides a view of another embodiment of a key mechanism of the present invention.

FIGS. 2 and 5 provides elevation views of another embodiment of the key mechanism of the present invention. This embodiment shows a slightly different configuration with the touch keys 13, 14 in different positions. Key 11 is configured to cover the C# tone hole. Key 12 is configured to cover the C# vent hole. Touch key 13 is positioned over key 11, but not key 12. However, lever 19 connects touch key 13 to key 12, such that when touch key 13 is depressed, both keys 11 and 12 are depressed, closing their respective holes. Similarly, key 15 is positioned over a tone hole, and is activated by touch key 14 so that when touch key 14 is depressed, key 15 depresses, covering its hole. It should be understood that in preferred embodiments, the C# vent hole key 12 is biased by a spring, such as a needle spring, in a closed position.

The key mechanism further comprises levers further allowing additional key control in various situations. Lever 16 connects tone hole key 15 to the C# tone hole key 11. While lever 16 is shown as a direct mechanical lever connection, it should be understood that any mechanical or equivalent connection between the two keys may be employed without straying from the scope of this invention. Further, it should be understood that C# tone hole key 11 can be closed without closing tone hole key 15. As such, when the tone hole key 15 is depressed, C# tone hole key 11 will also be depressed. Further, spring lever, having a spring side 17, and a lever side 18 is connected to the tone hole key 15. The spring lever spring side 17 is configured as a flexible member, such as a leaf spring. The spring side is resilient enough so that when tone hole key 15 is depressed, the lever will pivot about its connection 20, raising lever end 18. Lever end 18 is positioned under the C# vent hole key 12. Therefore, when the lever end 18 is raised, it lifts C# vent hole key 12 up against its biased down position, providing venting for the note. However, spring side 17 is flexible enough such that if touch key 13 is depressed (urging the C# vent hole key 2 up), along with touch key 14 (closing tone hole key 15) the spring can yield against the touch key force, allowing the C# vent hole key 12 to close against the force of the spring side 17 of the lever.

Figure 6:
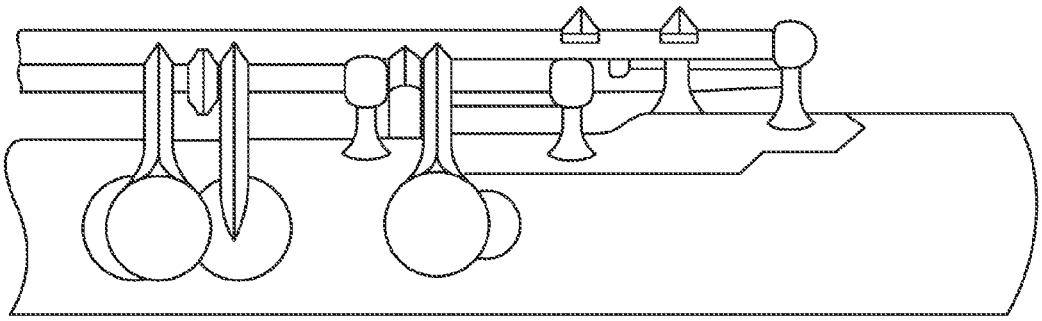
Prior Art Fig. 6
FIG. 6 provides a view of an embodiment of a key mechanism of a prior art instrument.

The above discussed embodiments of the key mechanism of the present invention shown in FIGS. 1, 2, and 5 may be seen in contrast to the prior art key mechanism, shown in FIG. 6.

Figure 3:
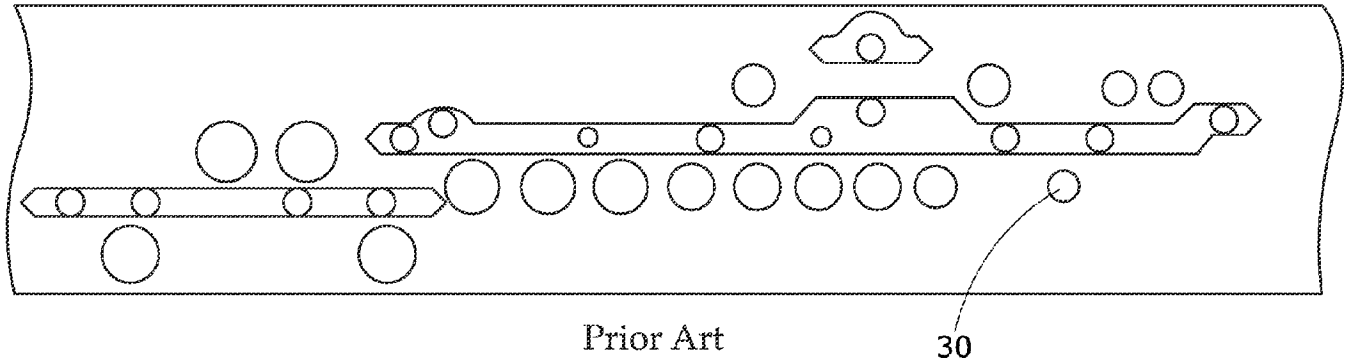
Prior Art Fig. 3
FIG. 3 provides a view of a tone hole configuration of a prior art instrument.
Figure 4:
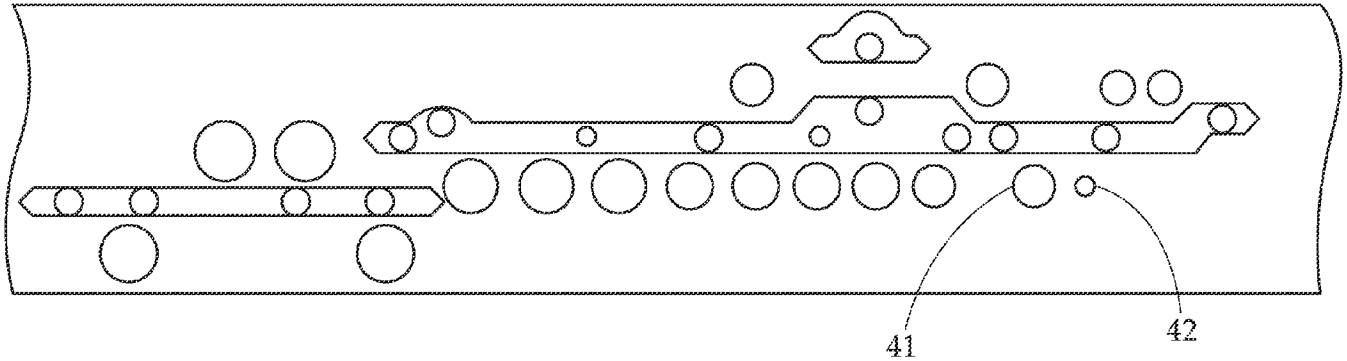
FIG. 4 provides a view of a tone hole configuration of an embodiment of the present invention.

FIGS. 3 and 4 provide comparison views of the prior art tone hole orientation (FIG. 3) compared to the tone hole configuration of the present invention (FIG. 4). The body of the prior art flute can be seen to have a single combined C# vent and tone hole 30. In contrast, the present invention has a C# tone hole 41, and a C# vent hole 42.

Figure 7:
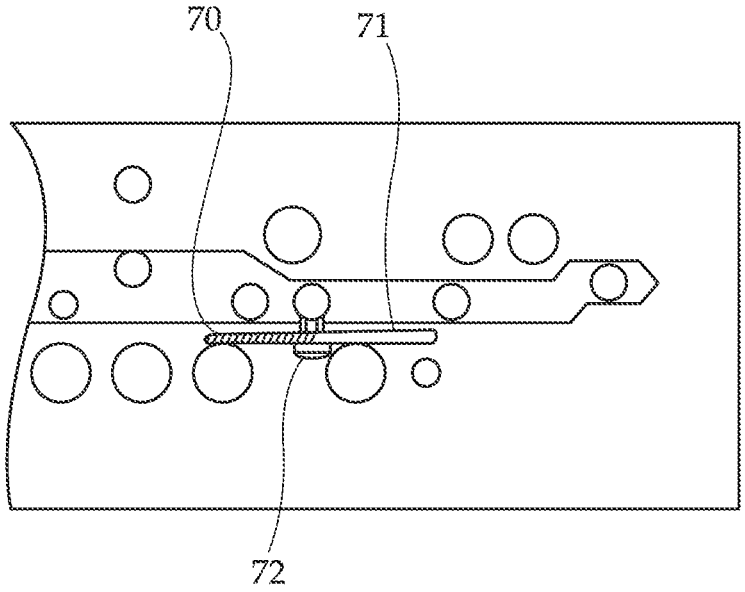
FIG. 7 provides an elevation view of an embodiment of the spring mechanism of the present invention.

FIG. 7 shows an elevation view of an embodiment of the spring lever of the present invention. The lever has two sides, a spring side 70 formed at least partially of a flexible member such as a leaf spring, and a lever side 71. The spring lever is connected to the body of the instrument at pivotal connection 72. Accordingly, the lever can pivot about this connection 72, allowing each end to move up and down, being limited in movement by the instrument body.

Figure 8:
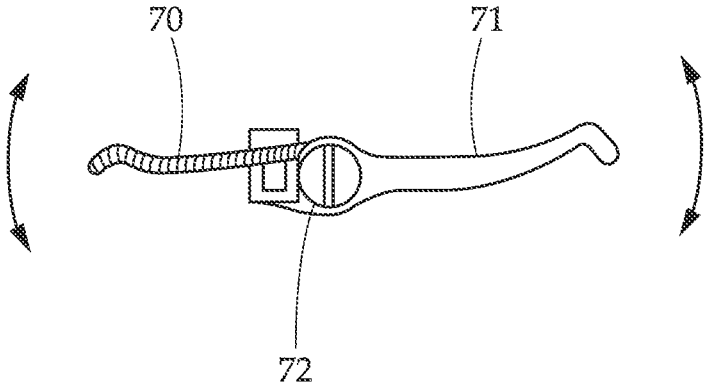
FIG. 8 provides a side view of an embodiment of the spring mechanism of the present invention.

FIG. 8 shows a side view of an embodiment of the spring lever of the present invention. Spring side 70 can be seen as a thin and flexible member, while lever side 71 is thicker. However, it should be understood that this configuration is non-limiting, and multiple different shapes, structures, and orientations may be employed allowing the spring side 70 to yield against a sufficient force on lever side 71. As demonstrated by the arrows, the sides can rotate about connection 72.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A key mechanism for a wind-blown instrument comprising:

a C# tone hole key configured to cover a C# tone hole when in a closed position, and movable between an open position and the closed position;

a C# vent hole key configured to cover a C# vent hole when in a closed position, the C# vent hole key positioned adjacent to the C# tone hole key, and movable between an open position and the closed position;

a touch key positioned to simultaneously move the C# tone hole key and C# vent hole key to the closed position when depressed, and movable between an open position and the closed position;

a second tone hole key configured to cover a tone hole other than the C# tone hole when in a closed position;

a mechanical connection between the second tone hole key and the C# tone hole key, such that when the second tone hole key is depressed, the C# tone hole key is also depressed; and a spring lever providing a mechanical communication between the second tone hole key and the C# vent hole key, such that when the second tone hole key is depressed, the C# vent hole key is opened, and wherein the spring lever may yield against a force of the touch key to close the C# vent hole key when the touch key is depressed.

2. The key mechanism of claim 1 wherein the spring lever has a flexible spring end adjacent to the second tone hole key, and a rigid lever in adjacent to the C# vent hole.

3. The key mechanism of claim 2 wherein the spring end is formed as a leaf spring.

4. The key mechanism of claim 1 wherein the spring lever is pivotally attached to the instrument.

5. The key mechanism of claim 1 wherein the C# tone hole cover is positioned over the C# tone hole, the C# tone hole selected to be of an optimal size and position, and the tone hole not sized for a venting.

6. The key mechanism of claim 1 wherein the wind-blown instrument is a flute.

7. The key mechanism of claim 1 wherein the wind-blown instrument is a piccolo.

8. The key mechanism of claim 1 wherein the touch key is sized and positioned to be at least partially over both the C# tone hole key and C# vent hole key, such that when depressed, it directly urges the keys below it downward.

9. The key mechanism of claim 1 wherein the C# vent hole key is biased in a closed position.

10. The key mechanism of claim 1 wherein the key mechanism is configured to bring the C# vent hole key to the open position when playing any of the D4, D#4, D5, G#5, A5, and A#5 pitches, thereby providing ventilation when playing those notes.

11. A flute comprising:

a body;

a plurality of holes defined by the body acting as tone holes and/or vent holes, the plurality of holes comprising a C# tone hole, and an adjacent C# vent hole;

a key mechanism attached to the body configured to open and close one or more of the plurality of tone holes and vent holes in a plurality of different configurations, the key mechanism comprising:

a C# tone hole key configured to cover a C# tone hole when in a closed position, and movable between an open position and the closed position;

a C# vent hole key configured to cover a C# vent hole when in a closed position, the C# vent hole key positioned adjacent to the C# tone hole key, and movable between an open position and the closed position;

a touch key positioned to simultaneously move the C# tone hole key and C# vent hole key to the closed position when depressed, and movable between an open position and the closed position;

a second tone hole key configured to cover a tone hole other than the C# tone hole when in a closed position;

a mechanical connection between the second tone hole key and the C# tone hole key, such that when the second tone hole key is depressed, the C# tone hole key is also depressed; and a spring lever providing a mechanical communication between the second tone hole key and the C# vent hole key, such that when the second tone hole key is depressed, the C# vent hole key is opened, and wherein the spring lever may yield against a force of the touch key to close the C# vent hole key when the touch key is depressed.

12. The flute of claim 11 wherein the spring lever has a flexible spring end adjacent to the second tone hole key, and a rigid lever in adjacent to the C# vent hole.

13. The flute of claim 12 wherein the spring end is formed as a leaf spring.

14. The flute of claim 11 wherein the spring lever is pivotally attached to the flute body.

15. The flute of claim 11 wherein the C# vent hole key is biased in a closed position.

16. A piccolo comprising:

a body;

a plurality of holes defined by the body acting as tone holes and/or vent holes, the plurality of holes comprising a C# tone hole, and an adjacent C# vent hole;

a key mechanism attached to the body configured to open and close one or more of the plurality of holes in a plurality of different configurations, the key mechanism comprising:

a C# tone hole key configured to cover a C# tone hole when in a closed position, and movable between an open position and the closed position;

a C# vent hole key configured to cover a C# vent hole when in a closed position, the C# vent hole key positioned adjacent to the C# tone hole key, and movable between an open position and the closed position;

a touch key positioned to simultaneously move the C# tone hole key and C# vent hole key to the closed position when depressed, and movable between an open position and the closed position;

a second tone hole key configured to cover a tone hole other than the C# tone hole when in a closed position;

a mechanical connection between the second tone hole key and the C# tone hole key, such that when the second tone hole key is depressed, the C# tone hole key is also depressed; and a spring lever providing a mechanical communication between the second tone hole key and the C# vent hole key, such that when the second tone hole key is depressed, the C# vent hole key is opened, and wherein the spring lever may yield against a force of the touch key to close the C# vent hole key when the touch key is depressed.

17. The piccolo of claim 16 wherein the spring lever has a flexible spring end adjacent to the second tone hole key, and a rigid lever in adjacent to the C# vent hole.

18. The piccolo of claim 17 wherein the spring end is formed as a leaf spring.

19. The piccolo of claim 16 wherein the spring lever is pivotally attached to the piccolo body.

20. The piccolo of claim 16 wherein the C# vent hole key is biased in a closed position.

* * * * *